United States Patent [19]

Fike

[11] 4,046,095

[45] Sept. 6, 1977

[54] MARINE VESSEL SCRUBBING DEVICE AND METHOD

[76] Inventor: Don G. Fike, 16 Town & Campus Apts., Fulton, Mo. 65251

[21] Appl. No.: 689,136

[22] Filed: May 24, 1976

Related U.S. Application Data

[63] Continuation-in-part of Ser. No. 630,807, Nov. 11, 1975, Pat. No. 4,007,701

[51] Int. Cl.[2] ..... B63B 59/00

[52] U.S. Cl. ..... 114/222

[58] Field of Search ..... 114/222; 15/DIG. 2

[56] References Cited

U.S. PATENT DOCUMENTS

| | | | |
|---|---|---|---|
| 3,227,124 | 1/1966 | Campbell | 114/222 |
| 3,662,417 | 5/1972 | Führing | 15/DIG. 2 X |
| 3,755,844 | 9/1973 | Ennis | 15/DIG. 2 X |

*Primary Examiner*—Stephen G. Kunin
*Assistant Examiner*—Sherman D. Basinger
*Attorney, Agent, or Firm*—Polster and Polster

[57] ABSTRACT

In a marine vessel hull cleaning device wherein a floating platform has spaced ways between which a vessel to be cleaned passes lengthwise, at least one transom scrubbing brush is supported from the platform, arranged to move clear of the vessel when the vessel moves between the ways, to move into transom engaging position and to be held in engagement with the transom of the vessel. Preferably, the vessel is both held in a position to permit the transom scrubbing brush to engage it and is moved up and down relative to the transom scrubbing brush by bottom scrubbing brushes which rotate in such a way as to tend to move the vessel astern.

4 Claims, 7 Drawing Figures

MARINE VESSEL SCRUBBING DEVICE AND METHOD

CROSS-REFERENCE TO RELATED APPLICATION

This application is a continuation-in-part of U.S. application Ser. No. 630,807, filed Nov. 11, 1975 and now U.S. Pat. No. 4,007,701.

BACKGROUND OF THE INVENTION

The problems of cleaning marine growth from vessels, and the general type of hull scrubbing device to which the present invention is directed, are illustrated and described in patents to Campbell, U.S. Pat. No. 3,227,124 and Locati, U.S. Pat. No. 3,561,391. The Campbell and Locati devices are effective for small craft, but their practical utility is limited to vessels having an 8 to 12 foot beam.

Devices intended for use to clean larger craft are frequently quite elaborate, such, for example as the devices of Romamo et al, U.S. Pat. No. 3,859,948, Seiple, U.S. Pat. No. 3,752,109, McLane, U.S. Pat. No. 630,260, Laney, U.S. Pat. No. 3,709,184 and Holland, U.S. Pat. No. 593,298.

None of the prior art devices of which applicant is aware has provision for a simple means for cleaning the transom of vessels which have a transom.

One of the objects of this invention is to provide a boat hull scrubbing device which includes means for scrubbing the transom of the boat, which is simple and effective.

Another object is to provide a method of using a simple transom scrubbing device by utilizing rotating hull bottom scrubbing brushes of the general types shown in Campbell, U.S. Pat. No. 3,227,124 and in applicant's co-pending application, Ser. No. 630,807.

Other objects will become apparent to those skilled in the art in the light of the following description and accompanying drawings.

SUMMARY OF THE INVENTION

In accordance with this invention, generally stated, in a marine vessel hull cleaning device wherein a floating platform has spaced ways between which a vessel to be cleaned passes lengthwise, at least one transom scrubbing brush supported from the platform is provided, which is mounted to move clear of the vessel when it moves between the ways, and is provided with means for moving into two transom engaging position. Means are also provided for holding the vessel in engagement with the transom scrubbing brush. In the preferred embodiment, the means for holding the vessel in engagement with the transom scrubbing brush include hull scrubbing brushes mounted for rotation on axes generally perpendicular to the long axis of the vessel and rotated in a direction such that the engagement of the hull scrubbing brushes with the hull of the vessel acts to bias the vessel astern. Further, in the preferred embodiment, the hull scrubbing brushes are positioned beneath the vessel and are so arranged and positioned with respect to the transom scrubbing brush as to permit their use to raise and lower the transom with respect to the transom scrubbing brushes.

Further, in the preferred embodiment, two transom scrubbing brushes are provided mounted on axes generally parallel to the long axis of the vessel when the brushes engage the transom. Preferably also, the two transom brushes are counterrotating, although they can be so arranged as to be reversible, deliberately to rock the vessel, to facilitate the hull scrubbing process.

DESCRIPTION OF THE PREFERRED EMBODIMENT

Figure 1:
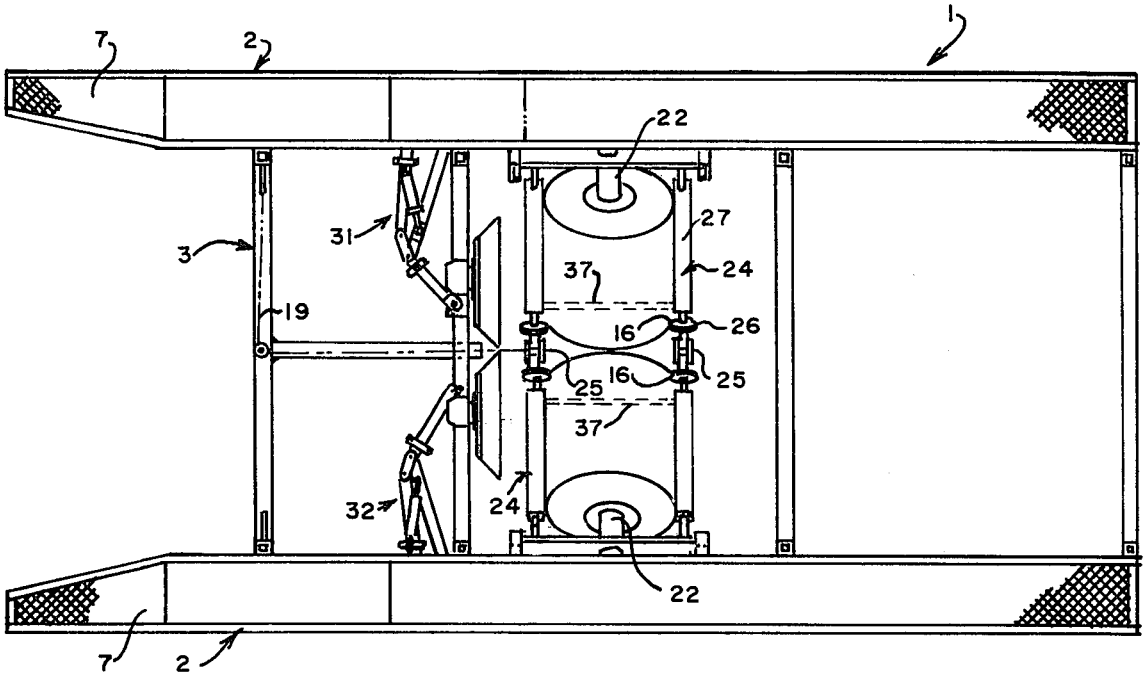
FIG. 1 is a top plan view of one illustrative embodiment of vessel scrubbing device of this invention, with power elements removed for clarity.

Referring now to the drawings for one illustrative embodiment of hull cleaning device of this invention, reference numeral 1 indicates a platform made up of ways 2 connected by cross members 3 secured below the ways 2 to uprights 4. The ways 2 in the embodiment shown include decks 7, welded to the uprights 4, beneath which brackets 8 are welded. Buoying blocks 10 are mounted on and below the brackets 8, to make the platform buoyant. The blocks 10 are styrofoam, although they can be any light, buoyant material or can be made in the form of air tanks.

As has been indicated in the description of the drawing, hydraulic pumps, electric motors by which the pumps are driven, oil storage tanks and the like are normally mounted on the platform, but these are conventional and are not here shown. A control stand 15 is indicated in dotted lines.

It will be understood that the uprights 4 extend below the deck 7 a distance greater than the draft of any vessel intended to be accommodated by the scrubbing device.

Figure 7:
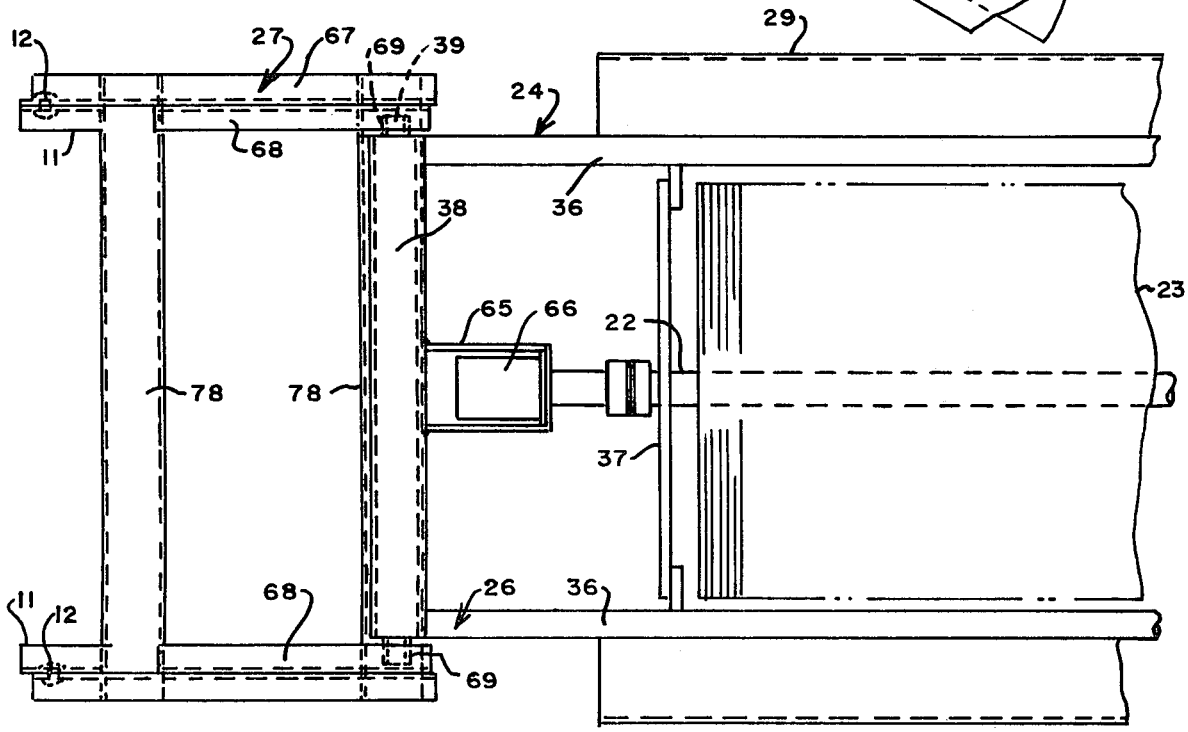
FIG. 7 is a top plan view of the hull scrubbing brush sub-assembly as shown in FIG. 6.

In the embodiment shown, hull brushes 20 and 21 of the general type shown and described in the U.S. Pat. to Campbell, U.S. Pat. No. 3,227,124 and those described in applicant's co-pending application, U.S. Pat. No. 630,807, are shown, with bristles 23 mounted on shafts 22. However, the mounting of and use of the brushes 20 and 21 are different from those of the prior art. The brushes 20 and 21 are mounted for rotation in frames 24, which, in the embodiment shown, each includes a rectangular, brush and float section 26 and a hinge section 27. The brush and float section 26 has tubular side members 37 to which side angles 29 are secured, on which brush buoying blocks 28 are mounted, upper and lower brush journal cross bars 37 in which the shaft 22 is journalled for rotation, and a trunion bar 38 from which trunions 39 project. The trunion bar 38 carries a motor housing 65 in which a hydraulic motor 66 is mounted. The shaft of the motor 66 is coupled to the shaft 22 as shown in FIG. 7. In the embodiment shown, wheels 16 are mounted for rotation on the side members 36 between the inboard ends of the angles 29 and the inboard ends of the side members 36.

The hinge section 27 includes main side channels 67 and races 68, secured to the main side channels, which open in a direction facing one another so as to accommodate the trunions 39. The trunions 39 have sleeve bushing 69 rotatably mounted on them to facilitate their travel in the races 68. Cross channels 78 complete the hinge section 27.

Vertical hinge plates 11, welded to members of the platform 1, support hinge pins 12 by which the hinge section 27 is hingedly mounted to the platform.

Figure 2:
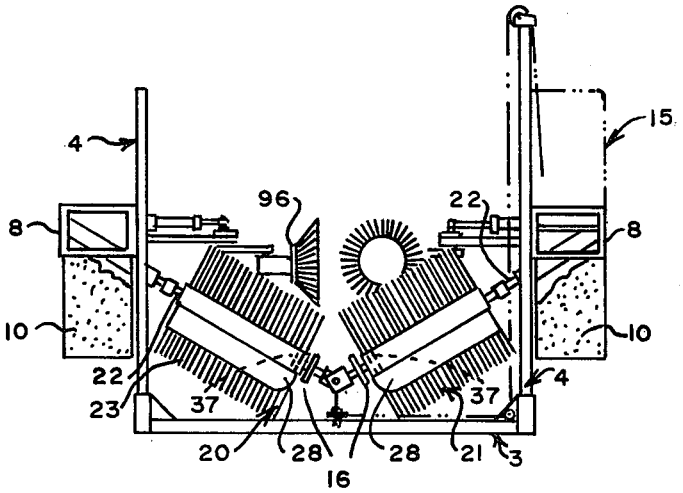
FIG. 2 is a view in end elevation of the device shown in FIG. 1.
Figure 3:
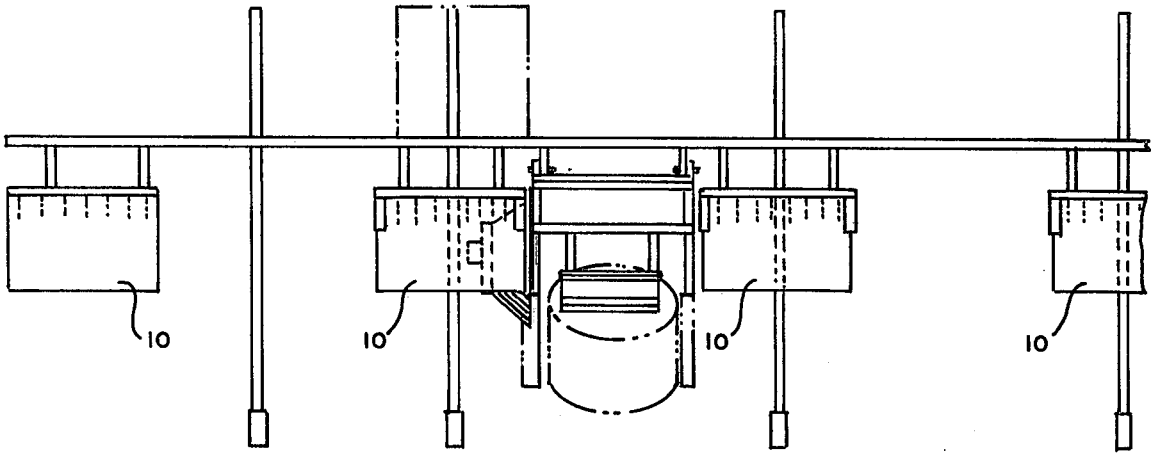
FIG. 3 is a view in side elevation of the device shown in FIGS. 1 and 2.

The inboard ends of the brush and float sections 26 are hinged together as shown at 25 in FIGS. 1 and 2. In the illustrative embodiment here described, a cable 19, running through a pulley block mounted on and beneath a cross member 3, is connected at one end to the frames 26 at their inboard ends, and at the other, to a winch mounted on the platform in such a way that the cable is and remains clear of the area above the brushes 20 and 21.

The buoyancy of the blocks 28 is so great that, together with the buoyancy of the brushes themselves, they will lift a vessel unless the frame 24, hence the brushes, is pulled down by force, in this embodiment by the cable 19 and its winch.

The hull scrubbing brushes are mounted to be rotated in a direction such that the upper, hull-engaging surface of the brushes moves from right to left as viewed in FIG. 1.

Figure 4:
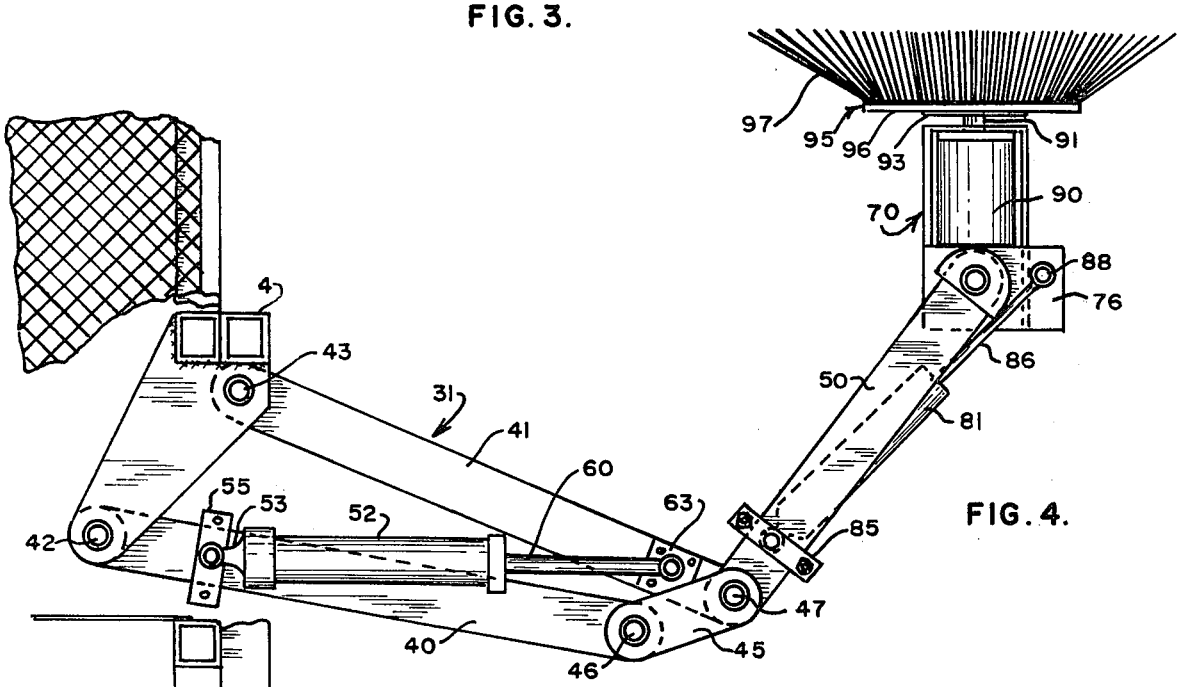
FIG. 4 is a fragmentary enlarged detail plan view of one transom scrubbing brush sub-assembly from the device shown in FIGS. 1–3.
Figure 5:
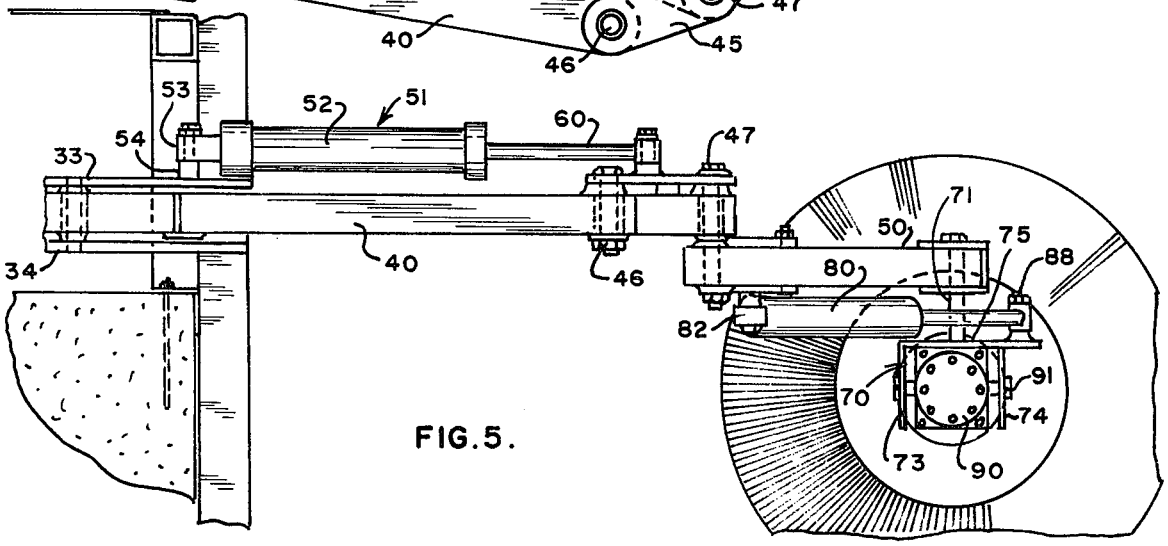
FIG. 5 is a fragmentary enlarged end view showing the sub-assembly of FIG. 4.
Figure 6:
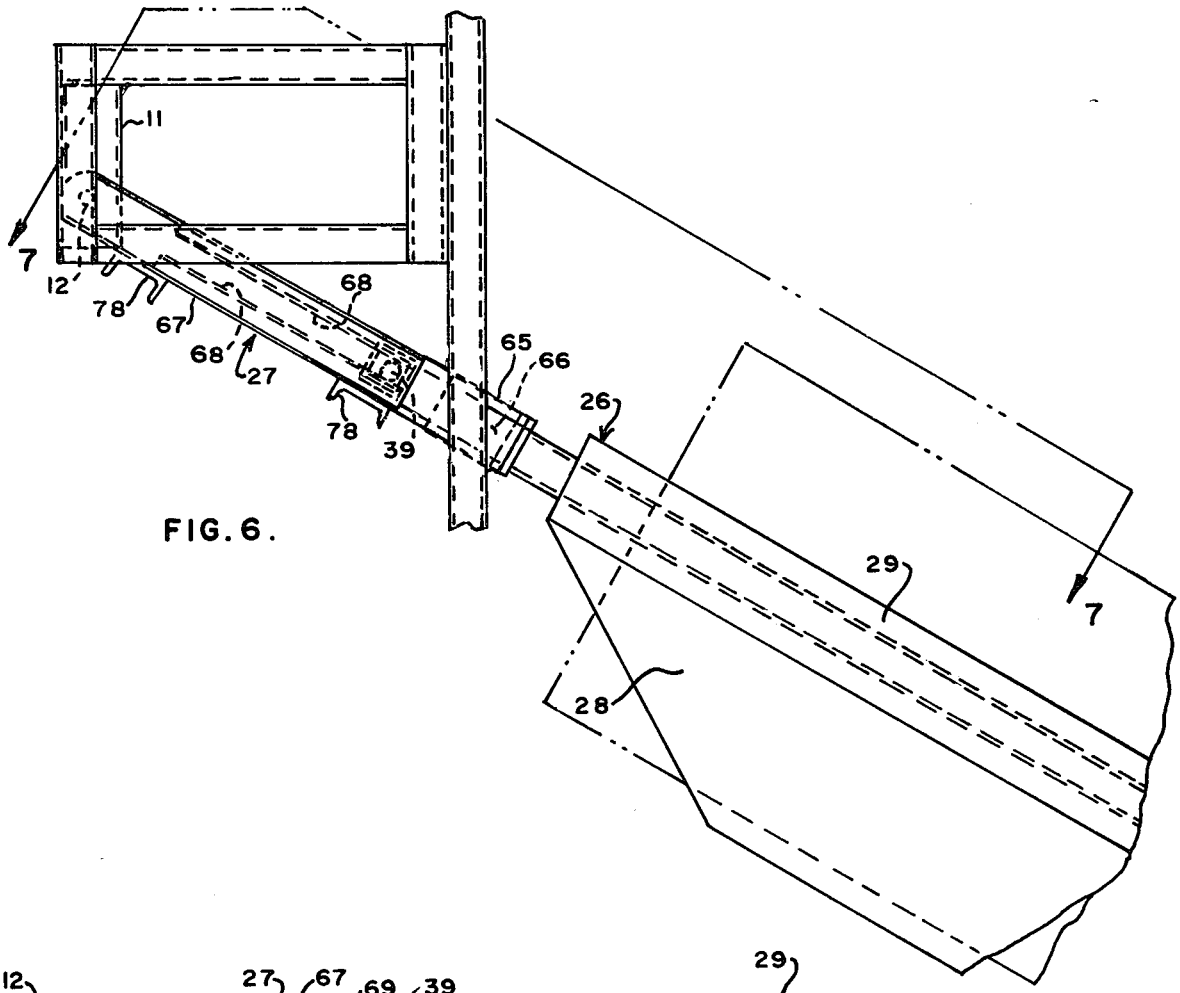
FIG. 6 is a fragmentary view in said elevation of one hull scrubbing brush sub-assembly of FIGS. 1–3.

Referring now particularly to FIGS. 1, 4 and 5, a transom scrubbing assembly 30 is hingedly mounted to the platform 1. The assembly 30 is made up, in the illustrative embodiment, of mirror image sub-assemblies 31 and 32, one on each of the ways 2. The description of the sub-assembly 31 which follows is identically applicable to the sub-assembly 32. In the embodiment shown, a double upright 4 is provided, to which a pair of hinge plates 33 and 34 are welded, spaced from and parallel to one another, and perpendicular to the uprights 4. Arms 40 and 41 are hingedly mounted at one end by means of hinge pins 42 and 43 respectively, to the hinge plates 33 and 34, and at their other ends, to a link 45, by means of hinge pins 46 and 47 respectively.

The pin 47 is long, and serves as a mount for an end of forearm 50 the pin 47 and forearm 50 are arranged to turn with the link 45.

A hydraulic assembly 51 includes a cylinder 52, with a mounting boss 53 at one end, by which it is pivotally mounted on a pin 64 to a bracket 55 securely mounted on the arm 40 as shown in FIGS. 4 and 5. A piston rod 60, reciprocatingly mounted at one end in the cylinder 51, is pivotally connected at its outer end to a mounting bracket 63 on the upper surface of the arm 41.

A brush support bracket 70 is pivotally mounted on the outer end of the arm 50, by means of a pin 71 journalled in a sleeve carried by the arm 50, as shown particularly in FIG. 5. The brush support bracket 70 is in the form of an inverted channel, with parallel side members 73 and 74 and a connecting top web 75, which, in the embodiment shown, projects beyond the side member 74 to provide an extension 76.

A brush-swivelling hydraulic assembly 80 includes a hydraulic cylinder 81 with a mounting boss 82 at one end, by which it is pivotally mounted to a mounting bracket 85 carried by the forearm 50. A piston rod 86 is mounted at one end for reciprocation within the cylinder 81, and is pivotally mounted at its outer end on a pintle 88 secured to the extension 76.

In the embodiment shown, a hydraulic motor 90 is trunion mounted by means of trunion pins 91 between the side members 73 and 74, as shown in FIG. 5, for limited rotation of the axes of the trunions, parallel to the arms 40 and 41 and the forearm 50, all as shown in FIG. 5.

A shaft 91 of the motor 90 is connected to a central hub 93 of a transom brush 95. The transom brush 95 of this embodiment is of the disc type, with a backing disc 96 from which bristles 97 project divergently outwardly.

Suitable hydraulic hose connections are provided between the cylinders 52 and 81 and the motors 90 and 66, and a conventional hydraulic system, and suitable connections between the various elements of the hydraulic system and controls in the control stand 15. These are conventional.

In the operation of the embodiment of scrubbing device shown and described above, the brushes 95 are swung to the left as viewed in FIG. 1, until the brushes are substantially parallel with the ways 2, and the brushes 20 and 21 are depressed, by retraction of the cable 19 by its winch, as far as is necessary to clear the vessel, the trunions of the frame 24 moving inboardly and outboardly in the races to accommodate the up and down movement of the brushes.

The vessel to be cleaned is moved between the ways, bow first, in a direction from left to right as viewed in FIG. 1, generally by a winch and cable, not here shown. The brushes 20 and 21 are brought into contact with the hull by controlled paying out of the cable 19 from its winch, and rotated by the motors 66, as has been indicated, against the direction of travel of the vessel, until the transom has reached a position to the right of the transom scrubbing brushes when they are moved to transom scrubbing position as shown in FIG. 1. The hydraulic cylinders 52 are then actuated to bring the brushes to the position shown in FIG. 1. The trunion mounting of the brushes permits them to cant to conform to the slope of a transom. The cylinders 81 can be actuated to adjust the position of each brush around the axis of the pin 88 at right angles to the axes of the trunions.

The motor 90 is then actuated to cause the brushes 95 to rotate. The brushes 20 and 21 are also still rotating, and if the vessel is being pulled through the device by a cable, the cable is slacked off enough to permit the brushes 20 and 21 to move the boat firmly against the brushes 95. The buoyancy of the brushes 20 and 21 and the blocks 28 is sufficient to cause the vessel being cleaned to rise when the cable 19 is slacked off. The wheels 16 serve to protect the frame 24, the hull of the vessel, and the bristles of the brushes by engaging the vessel when the brushes have risen sufficiently. The linkage of the transom scrubbing assembly is such as to permit the brushes to be moved from the center line outboardly. Thus, by manipulating the two sets of brushes, the transom of the vessel can be cleaned both heightwise and widthwise.

The operation of the device of this invention is the same whether the platform and brush mechanisms are of the type shown in Campbell U.S. Pat. No. 3,227,124 or in applicant's co-pending application Ser. No. 630,807.

The method of the preferred embodiment of this invention, in which the hull scrubbing brushes 20 annd 21 or their equivalent are used to hold the vessel against the transom scrubbing brushes, can be performed with transom scrubbing brushes of different types. For example, a cylinder type brush such as the brushes 20 and 21 can be journalled for rotation on an axis parallel to the cross members 3 in bearings which can be moved vertically to a position at which the vessel clears the brush, and then raised or lowered, as the case may be, to a transom-engaging position. In this case, as in the case of the preferred embodiment, the brushes 20 and 21 will serve to move the vessel or to hold it in position.

While the preferred embodiment described has many advantages in simplicity of construction and ruggedness, the transom scrubbing assembly can be made in such a way as to permit the brushes 95 to be moved vertically, relieving the brushes 20 and 21 of the necessity of moving the stern of the vessel up and down.

Numerous variations within the scope of the appended claims in the construction of the device of this invention and modifications of the method of this invention will occur to those skilled in the art in the light of the foregoing disclosure. Merely by way of illustration, the hinge plates 33 and 34 can be connected, and mounted on a vertically movable carriage, so as to move the sub-assembly vertically. Two roller type brushes, arranged to move either vertically or horizontally with respect to the transom, can be employed. If only a single rotary type brush is employed, the brush will tend to force the stern of the vessel either upwardly or downwardly if the brush is mounted to rotate about a horizontal axis, or to one side or the other if it is mounted on a vertical axis. Counterrotating disc type brushes have the advantage that the forces tending to move the vessel are largely counterbalanced. Other linkages and arrangements for swinging the brushes out of the way and into operative position can be employed. The frame in which the hull brushes are mounted can be arranged to move up and down in slides, instead of being pivoted at its ends. As has been indicated, these are merely illustrative.

Having thus described the invention, what is claimed and desired to be secured by Letters Patent is:

1. In a marine vessel hull cleaning device wherein a floating platform has spaced ways between which a vessel to be cleaned passes lengthwise, the improvement comprising hull scrubbing brushes mounted for rotation on axes generally perpendicular to the long axis of the vessel and at least one transom scrubbing brush supported from said platform, means for moving said transom scrubbing brush clear of the path of said vessel when said vessel moves between said ways, means for moving said transom scrubbing brush into transom engaging position, means for holding said vessel in engagement with said transom scrubbing brush, said holding means comprising means for rotating said hull brushes in a direction such that the engagement of said brushes with the hull of the vessel acts to bias the vessel astern, and means for moving the vessel up and down with respect to said transom scrubbing brushes while the said transom of said vessel is held in engagement with said transom scrubbing brushes.

2. In a marine vessel hull cleaning device wherein a floating platform has spaced ways between which a vessel to be cleaned passes lengthwise, the improvement comprising hull scrubbing brushes mounted for rotation on axes generally perpendicular to the long axis of the vessel and at least one transom scrubbing brush supported from said platform, means for moving said transom scrubbing brush clear of the path of said vessel when said vessel moves between said ways, means for moving said transom scrubbing brush into transom engaging position, means for holding said vessel in engagement with said transom scrubbing brush, said holding means comprising means for rotating said hull brushes in a direction such that the engagement of said brushes with the hull of the vessel acts to bias the vessel astern, said transom scrubbing brush being generally fixed in position vertically and movable in a horizontal plane, and means for moving the vessel up and down with respect to said transom scrubbing brushes, said means comprising a frame in which the hull scrubbing brushes are journalled, and buoyant means mounted on said frame for buoying said frame, hence said brushes, means, including said brushes, for transmitting said buoyancy to said vessel, and means for selectively forceably moving said frame, against said buoyancy, away from said vessel.

3. The improvement of claim 2 wherein each brush is mounted in a frame, pivoted at one end to the platform, and hinged to another frame at its inboard end, each frame having two sections adopted to move telescopically when the frames are moved up and down.

4. A method of scrubbing the hull and transom of a vessel comprising positioning hull engaging rotating brushes against the hull; positioning transom engaging brushes in a position to engage the transom of said vessel; while moving said transom engaging brushes to scrub said transom, rotating the hull scrubbing brushes in a direction such as to bias the vessel toward and against said transom scrubbing brushes, and, while said transom scrubbing brushes engage the transom, moving the transom up and down with respect to said transom scrubbing brushes.

* * * * *